United States Patent [19]

Wilcox et al.

[11] **Patent Number: *4,518,282**

[45] Date of Patent: May 21, 1985

[54] MINE ROOF BEARING PLATE WITH EMBOSSED AREA HAVING CONICAL AND CYLINDRICAL SECTIONS

[75] Inventors: Raymond J. Wilcox, Rancho Bernardo; Earl W. Powers, Chula Vista, both of Calif.

[73] Assignee: Republic Corporation, Century City, Calif.

[21] Appl. No.: 297,011

[22] Filed: Aug. 27, 1981

[51] Int. Cl.[3] ..... E21D 21/00

[52] U.S. Cl. ..... 405/259; 411/531

[58] Field of Search ..... 405/259, 260; 411/531, 411/537, 538, 9–11

[56] References Cited

U.S. PATENT DOCUMENTS

| | | | |
|---|---|---|---|
| D. 236,428 | 8/1975 | Stewart et al. | D8/399 |
| 2,748,594 | 6/1956 | Edwards | 405/259 |
| 2,854,824 | 10/1958 | Curry et al. | 405/259 |
| 3,090,203 | 5/1963 | Durget | 405/259 |
| 3,161,174 | 12/1964 | Harrison | 405/259 X |
| 3,163,012 | 12/1964 | Dempsey | 405/259 |
| 3,238,731 | 3/1966 | Seifert et al. | 405/259 |
| 3,415,064 | 12/1968 | Talobre | 411/531 |
| 3,415,066 | 12/1968 | Williams | 405/260 |
| 3,478,523 | 11/1969 | Reusser et al. | 405/259 |
| 3,695,045 | 10/1972 | Williams | 405/259 |
| 4,095,431 | 6/1978 | Hannan | 405/259 |
| 4,112,693 | 9/1978 | Collin et al. | 405/259 X |
| 4,371,293 | 2/1983 | Wilcox et al. | 405/259 |

FOREIGN PATENT DOCUMENTS

| | | | |
|---|---|---|---|
| 1222640 | 6/1960 | France | 405/259 |
| 968630 | 9/1964 | United Kingdom | 405/259 |

*Primary Examiner*—Dennis L. Taylor

*Attorney, Agent, or Firm*—Fleit, Jacobson, Cohn & Price

[57] ABSTRACT

A bearing plate for supporting a portion of a mine roof or similar surface. The bearing plate includes a substantially planar, roof-bearing portion having a roof-bearing surface. Also included is a substantially planar bolt-head bearing surface. The bolt-head bearing surface includes a concentrically located aperture adapted to receive a roof bolt having a bolt head. The bolt-head bearing surface is spaced from the planar roof-bearing portion and is substantially parallel to the roof-bearing surface. A wall extends at an angle from the bolt-head bearing surface about its outer periphery. A reinforcing wall extends radially outward from the distal end of the angled wall and merges with the roof-bearing portion. The reinforcing wall defines a frusto-conical portion, the base of which is conterminous with the roof-bearing portion, and a cylindrical portion, the base of which merges with the distal end of the frusto-conical portion. The diameter of the base of the cylindrical portion is less than the diameter of the distal end of the frusto-conical portion. The roof bearing surface of the bearing plate, when in use, supports a portion of the mine roof in response to a bearing force applied to the bolt-head bearing surface by the roof bolt.

11 Claims, 3 Drawing Figures

MINE ROOF BEARING PLATE WITH EMBOSSED AREA HAVING CONICAL AND CYLINDRICAL SECTIONS

BACKGROUND OF THE INVENTION

1. Field of the Invention

This invention relates to load-bearing plates adapted to provide support for a generally planar surface, in general, and to mine roof bearing plates, in particular.

2. Description of the Prior Art

Attempts have been made in the past to provide mine roof plates made from a relatively thin material. In addition, there are many known examples of mine roof plates exhibiting high strength and rigidity under bolt-loading by means of deepdishing or excessive material thickness. However, in recent years there has been a trend in the mining industry toward the use of thinner plates in order to reduce cost, and minimize weight and installation problems.

Although there have been a number of prior designs for mine roof bearing plates, those which have been most readily accepted as meeting governmental standards have taken one of two primary design configurations: the so-called "donut-type" and the "bell-type". The donut-type is embossed in a manner such that a portion thereof, taken in cross section, looks very much like a donut; and the bell-type is embossed in a manner such that a cross section thereof looks very much like a flattened bell. In some instances, these plates are made from relatively more expensive high-tensile grade steel. Many variations of these two basic concepts exist in the prior art.

The United States Bureau of Mines, in existing specifications relating to bearing plates, indicates that one of the most important features of a bearing plate is its ability to resist axial deflection when it is fully bolt-loaded. To measure axial deflection, the government working with the American Society for Testing and Materials (ASTM) has developed a standard test. A mine bearing plate under test is placed on a standard test plate which contains a four-inch diameter opening. Specific preloads are applied to the bearing plate with the resultant axial deflection being measured. The four-inch diameter figure has been selected because this represents the crumbling loss in the bearing area with loads concentrated adjacent to a bolt hole drilled in a mine roof. Presently, to confirm that a bearing plate is of sufficient rigidity, the axial deflection of the plate, as it is bolt-loaded from 6,000 to 15,000 pounds, should be no greater than 0.120 inches. The deflection of the plate, as it is bolt-loaded from 6,000 to 20,000 pounds, should be no greater than 0.250 inches.

There is, thus, a need for a bearing plate made from a thinner and less expensive material than has heretofore been possible and which still meets or exceeds all government standards. The subject invention is directed toward filling that need.

BRIEF DESCRIPTION OF THE INVENTION

As used herein, the term "bearing plates" includes plate washers, mine roof plates, and header plates. A bearing plate is defined as a plate that serves to distribute the load from the exposed end of a bolt or threaded bar to the rock face or intermediate member. A header plate is a large rectangular bearing plate, usually six inches wide by sixteen to eighteen inches long, or any other shape with an equivalent area, used in substitution for wooden header blocks for wider distribution of the bolt load than is possible with standard bearing plates.

In accordance with the present invention, there is provided a bearing plate for supporting a portion of a mine roof or similar surface. The bearing plate includes a substantially planar, roof-bearing portion having a roof-bearing surface. Also included is a substantially planar bolt-head bearing surface. The bolt-head bearing surface includes a concentrically located aperture adapted to receive a roof bolt having a bolt head. The bolt-head bearing surface is spaced from the planar roof-bearing portion and is substantially parallel to the roof-bearing surface. An angled wall extends away from the bolt-head bearing surface about its outer periphery. A reinforcing wall extends radially outward from the distal end of the angled wall and merges with the roof-bearing portion. The reinforcing wall defines a frusto-conical portion, the base of which is conterminous with the roof-bearing portion, and a cylindrical portion, the base of which merges with the distal end of the frusto-conical portion. The diameter of the base of the cylindrical portion is less than the diameter of the distal end of the frusto-conical portion. The roof-bearing surface of the bearing plate, when in use, supports a portion of the mine roof in response to a bearing force applied to the bolt-head bearing surface by the roof bolt.

It is thus an object of the present invention to provide a bearing plate made of a thinner material than has heretofore been possible, while meeting or exceeding present government standards for such plates.

It is another object of the present invention to provide a bearing plate which deflects less than the present government standards which specify maximum allowable axial deflection.

It is still another object of the present invention to provide a bearing plate made from less expensive material than has heretofore been possible, while meeting or exceeding present government standards for such plates.

It is a further object of the present invention to provide a low-carbon steel bearing plate that meets or exceeds all present government standards for bearing plates.

It is yet an object of the present invention to provide a bearing plate having a unique embossed area to allow the bearing plate to be made from thinner, less expensive material than has heretofore been possible, while meeting or exceeding present government standards for such plates.

Other objects and advantages of this invention will further become apparent hereinafter and in the drawings, in which:

DESCRIPTION OF THE PREFERRED EMBODIMENTS

Figure 1:
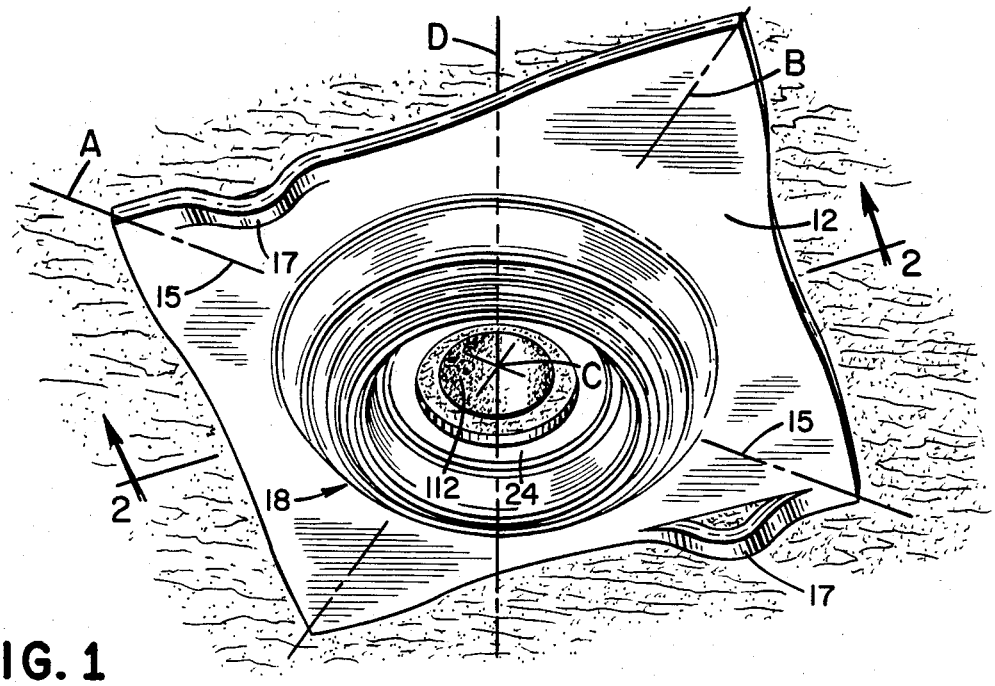
FIG. 1 is a perspective of a mine roof plate embodying the subject invention, and oriented in a position of use against a portion of a mine roof.

In describing the preferred embodiment of the invention illustrated in the drawings, specific terminology will be resorted to for the sake of clarity. However, it should be understood that the invention is not to be limited to the specific terms so selected, and it is to be further understood that each specific term includes all technical equivalents which operate in a similar manner to accomplish a similar purpose.

Referring now to the figures, there is shown a bearing plate, also referred to as a mine roof plate, embodying the subject invention. The bearing plate, generally designated as 10, has a generally planar square body 12 having peripheral dimensions of approximately six inches square. The final bearing plate configuration is slightly deformed from the substantially square configuration due to material-gathering taking place during the manufacture of the plate. The bearing plate is preferably made from a low carbon steel. It has been found that the subject invention is best practiced with a steel plate having a thickness in the range of about 0.100 inches to 0.150 inches, with a thickness of approximately 0.125 inches being preferred when low carbon steel is used. With high strength low alloy steels, satisfactory results have been achieved with plate thicknesses less than 0.090 inches. One face 14 of the body defines a roof-bearing or support surface, while the opposed face 16 defines an outer surface. Diagonal lines A and B, drawn along the plane defined by the body 12, intersect at point C to define the center of the body. An axis D extends through point C and is perpendicular to the plane formed by the diagonals A and B.

Concentric about axis D, is an upwardly extending embossed area, generally designated as 18. The base of the embossed area 18 merges with the body 12 by means of a curved portion 20. Curved portion 20, as well as any other curved portion referred to hereinafter, deviates from planarity in a smooth and continuous fashion.

Figure 2:
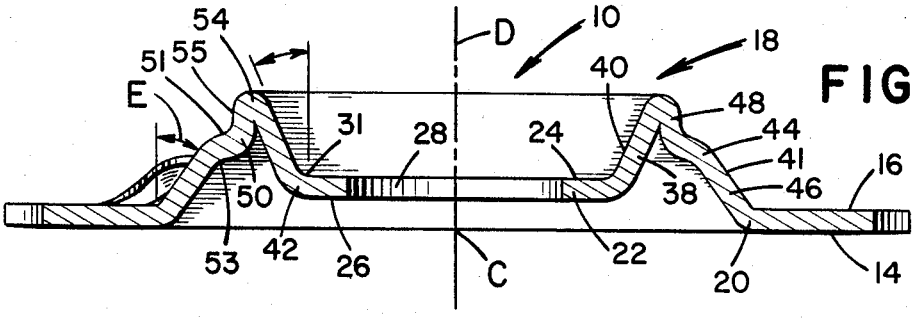
FIG. 2 is a sectional view taken along lines 2—2 of FIG. 1.

With further reference to FIGS. 1 and 2, the structure of the embossed area 18 will now be described. An opening within the embossed area is defined by the curved portion 20 and has a diameter which is typically 3.77 inches. Forming a portion of the embossed area is a substantially planar circumferential bolt-head bearing portion 22, which has a bolt-head bearing surface 24 and an opposite surface 26. Concentric about axis D is an aperture 28 located substantially at the center of the bolt-head bearing portion 22. The diameter of the aperture 28 varies according to the shank diameter of the roof bolt being used.

A wall 38 extends upwardly away from the bolt-head bearing surface 24 along the periphery of the bolt-head bearing portion 22 to define an inverse frusto-conical surface 40 on the embossed area 18. The surface 40 is preferably at an angle of about 22° with reference to axis D, but may deviate from this position in either direction within the range of about 0° to 10°. The frusto-conical surface 40 has an inner diameter, as measured at 31, which is typically 2.07 inches. The origin of the wall 38 merges with the periphery of the bolt-head bearing portion 22 by means of curved portion 42, which has an inner radius that is typically about 0.03 inches.

Forming a further portion of the embossed area 18 is a reinforcing wall, generally designated as 44, which extends upwardly away from outer surface 16 and radially inward toward axis D. The reinforcing wall 44 is defined by two sections 46 and 48; both sections are concentric about axis D. The first section 46 is a frusto-conical section defined by a portion of a cone having a base diameter which is typically 3.77 inches. The first section defines an outer frusto-conical surface 41 having a vertex angle E typically in the range of about 30° to 40°, with 36° being Preferred. The height of the first frusto-conical section 46, measured from its distal end to the plane defined by bearing surface 14 is typically 0.59 inches. The second section 48 is a cylindrical section defined by a portion of a right cylinder having a base diameter which is typically 2.90 inches. The second section 48 defines outer cylindrical surface 55. The base of the cylindrical section 48 merges into the distal end of the frusto-conical section by means of curved portion 50. Curved portion 50 has a first inner radius 51 typically in the range of about 0.03 to 0.09 inches with 0.06 being preferred. At the same time, curved portion 50 has a second inner radius 53 typically in the range of about 0.00 to 0.14 inches with 0.12 being preferred. The cylindrical section 48 terminates at its distal end at a distance which is typically 0.88 inches from the plane defined by bearing surface 14. The distal end of the wall 38 merges with the distal end of the cylindrical portion 48 by means of curved portion 54.

As best seen in FIG. 1, body portion 12 contains a conventional hanger 17 formed near opposite corners 15 of plate 10. Typically, only one such hanger is provided. However, more than one hanger may be provided depending on the intended use. Such hangers are used for facilitating the installation of electrical wiring, lighting fixtures and telephone lines.

In the preferred embodiment, a low carbon steel, having a rating of at least about 30,000 psi minimum yield strength, is contemplated for use in order to meet or surpass the strength requirements set by various governmental bodies. This represents a significant savings over high tensile steel, which is currently being widely used for the manufacture of bearing plates. Further, the thickness of the steel plate preferably used is typically on the order to 0.125 inches, which is significantly thinner than most other bearing plates currently being used or manufactured, thus providing additional economic advantages.

Figure 3:
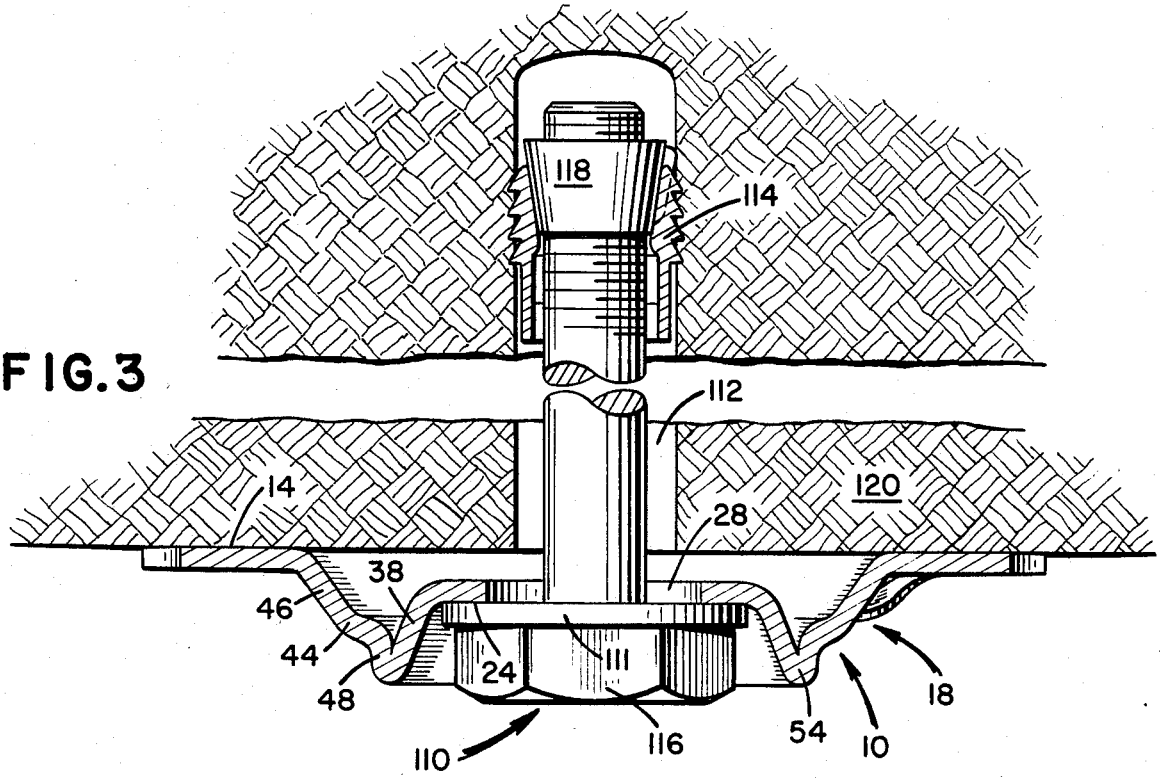
FIG. 3 is a cross-sectional view, partly in pictorial, showing a typical installation of the subject bearing plate.

Referring now to FIG. 3, the installation of the subject bearing plate in a mine roof will now be described. The mine roof plate 10 contains the centrally-disposed aperture 28 for receiving a conventional roof bolt fastener 110. The fastening bolt 110 is adapted to be inserted into a suitable hole 112, which is drilled by conventional means into the strata of the mine roof. Any of several conventional anchoring devices or expansion shells 114 with antirotation plugs 118 may be employed to secure the fastening bolt 110 in the opening 112. The fastening bolt 110 contains a conventional bolt head 116 for cooperating with the substantially planar bolt-head bearing surface 24 of the bearing plate 10 via a conventional washer 111 interposed between the surface 24 and the bolt head 116.

Typically, fastening bolts 110 are manufactured with head heights of approximately 0.625 inches for smooth bar and 0.688 inches for rebar measured over the integrally forged washer 111 under the bolt head 116. This would allow approximately 0.125 to 0.188 inches of the bolt head to protrude beyond the plate. When used with a separate washer under the head, this protrusion would increase by the thickness of the washer, typically 0.125 inches.

The bolt 110, by conventional means applied to the bolt head 116, turns to expand the shell 114 and draw the plate 10 up against the mine roof 120. In this way, the bearing surface 14 of the plate 10 is brought into load bearing relationship with the surface of the mine roof 120.

When the bolt head 116, via the washer 111, applies a bearing force on the bolt-head bearing surface 24, the force is translated to the roof-bearing surface 14 via the wall 38 and the reinforcing wall 44 to support a portion of the mine roof 120. The cylindrical wall portion 48, by being substantially perpendicular to the bolt-head bearing surface 24, does not bend when the bearing force is applied to the bolt-head bearing surface 24; thus, the cylindrical portion 48 adds additional strength and rigidity to the embossed area 18. The arrangement between the reinforcing wall 44 and the wall 38 afforded by the small radius of curved portion 54 provides the embossed area 18 with a structure which is highly resistant to deflection, resulting in a bearing plate which meets or exceeds government standards, while being made from thinner and less expensive materials.

In particular, the curved portion 54 that joins the distal ends of wall 38 and cylindrical portion 48 is formed with a sharp inside radius. A cross section of the area, as viewed in FIG. 2, shows that the curved portion 54 is about twice as thick as the metal layer used to form the plate 10. This eliminates a weakness common to existing designs which are formed with a relatively large radius in this same area. The large radius provides a path for material flow when a load is applied. In order to overcome this fault, prior existing designs use materials of sufficient thickness to meet government test standards. This material flow is eliminated in the new design by the sharp radius and double material thickness. The applied load is supported by, and divided between, the wall 38 and reinforcing wall 44. These walls are locked together by curved portion 54 and cylindrical portion 48.

Obviously, many modifications and variations of the present invention are possible in light of the above teachings, and it is, therefore, to be understood that, within the scope of the appended claims, the invention may be practiced otherwise than as specifically described.

What is claimed is:

1. A bearing plate for supporting a portion of a mine roof or similar surface, said bearing plate comprising:

roof-bearing means including a roof-bearing surface for supporting said portion of said mine roof;

bolt-head bearing means including an aperture adapted to receive a roof bolt having a bolt head;

a reinforcing wall divided into a frusto-conical portion, the base of which is connected to said roof-bearing means, and a cylindrical portion, the base of which is connected to the distal end of said frusto-conical portion, the diameter of the base of said cylindrical portion being less than the diameter of the distal end of said frusto-conical portion, said cylindrical portion being substantially perpendicular to said bolt-head bearing means; and wall means connecting the distal end of said cylindrical portion with said bolt-head bearing means for translating a bearing force applied to said bolt-head bearing means by said bolt-head to said bearing surface for supporting said portion of said mine roof.

2. The bearing plate of claim 1, wherein said wall means comprises a frusto-conical surface having its base connected to said distal end of said cylindrical portion and its top connected to said bolt-head bearing means.

3. The bearing plate of claim 1, wherein said roof-bearing means comprises a substantially planar body portion having a periphery, said roof-bearing surface, and an outer surface.

4. The bearing plate of claim 3, wherein said bolt-head bearing means, said wall means, and said reinforcing wall constitute an embossed area on said planar body portion.

5. The bearing plate of claim 1, wherein said frusto-conical portion has a vertex angle in the range of about 30° to about 40°.

6. The bearing plate of claim 1, wherein said frusto-conical portion has a vertex angle of approximately 36°.

7. The bearing plate of claim 1, wherein said wall portion has a vertex angle of approximately 22°.

8. A bearing plate for supporting a portion of a mine roof or similar surface, said bearing plate comprising:

a bolt-head bearing portion including an aperture adapted to receive a roof bolt having a bolt head;

a substantially planar roof bearing portion spaced apart from said bolt-head bearing portion, said roof bearing portion including a bearing surface for supporting said portion of said mine roof;

a reinforcing wall divided into a frusto-conical portion, the base of which is connected to said roof bearing portion, and a cylindrical portion, the base of which is connected to the distal end of said frusto-conical portion, the diameter of the base of said cylindrical portion being less than the diameter of the distal end of said frusto-conical portion, said cylindrical portion being substantially perpendicular to said bolt-head bearing means; and a wall portion connecting the distal end of said cylindrical portion with said bolt-head bearing portion so that a bearing force applied to said bolt-head bearing portion by said bolt-head is translated to said roof-bearing surface to support said portion of said mine roof.

9. A bearing plate for supporting a portion of a mine roof or similar surface, said bearing plate comprising:

roof-bearing means including a roof-bearing surface for supporting said portion of said mine roof;

bolt-head bearing means including an aperture adapted to receive a roof bolt having a bolt head;

a reinforcing wall divided into a frusto-conical portion, the base of which is connected to said roof-bearing means, and a cylindrical portion, the base of which is connected to the distal end of said frusto-conical portion, the diameter of base of said cylindrical portion being less than the diameter of the distal end of said frusto-conical portion; and a wall portion connecting the distal end of said cylindrical portion with said bolt-head bearing means for translating a bearing force applied to said bolt-head bearing means by said bolt-head to said bearing surface for supporting said portion of said mine roof, said wall portion and said distal end of said cylindrical portion connected by a curved portion formed with a sharp inside radius such that a cross section of said curved portion has about a double material thickness.

10. The bearing plate of claim 1, wherein the connection between said frusto-conical portion and said cylindrical portion is a curved portion having a first inner radius and a second inner radius, said first inner radius being smaller than said second inner radius.

11. The bearing plate of claim 1, wherein said reinforcing wall is symmetrical about an axis substantially perpendicular to said roof bearing surface.

* * * * *